United States Patent [19]

Momose et al.

[11] 4,282,716

[45] Aug. 11, 1981

[54] STIRLING CYCLE REFRIGERATOR

[75] Inventors: Yutaka Momose, Toyota; Kazuaki Nakamura, Kariya, both of Japan

[73] Assignee: Aisin Seiki Kabushiki Kaisha, Kariya, Japan

[21] Appl. No.: 39,608

[22] Filed: May 16, 1979

[30] Foreign Application Priority Data

May 16, 1978 [JP] Japan ..... 53-58109

[51] Int. Cl.[3] ..... F25B 9/00; F01B 29/10; F02G 1/04

[52] U.S. Cl. ..... 62/6; 60/517

[58] Field of Search ..... 62/6; 60/517

[56] References Cited

U.S. PATENT DOCUMENTS

| | | | |
|---|---|---|---|
| 2,272,925 | 2/1942 | Smith | 62/6 |
| 3,147,600 | 9/1964 | Malaker et al. | 62/6 |
| 3,478,511 | 11/1969 | Schwemin | 62/6 |
| 4,080,788 | 3/1978 | Kantz | 60/517 |

*Primary Examiner*—Lloyd L. King

*Attorney, Agent, or Firm*—Finnegan, Henderson, Farabow, Garrett & Dunner

[57] ABSTRACT

Stirling cycle refrigerator comprising a pair of compression chambers provided at diametrically opposite positions, a pair of compressor pistons positioned respectively in the compression chambers for reciprocating movement therein, a pair of displacer chambers provided at diametrically opposite positions with each other, the displacer chambers being located along a diametrical line which makes an angle of 90° with respect to a diametrical line along which the compression chambers are located, a pair of displacer pistons positioned respectively in the displacer chambers for reciprocating movement therein, rotatable swash plate means associated with the compressing and displacer pistons for producing reciprocating movements of the pistons, one of the compressing chambers being connected with one of the displacer chambers, and the other compression chamber being connected with the other displacer chamber so that stirling cycles are effected when the swash plate means is effected.

5 Claims, 2 Drawing Figures

STIRLING CYCLE REFRIGERATOR

The present invention relates to stirling cycle refrigerators and more particularly to swash plate type stirling cycle refrigerators.

In general, a swash plate type stirling cycle refrigerator is of a three or four cylinder type so that the working phases of the compressor sections and the displacer sections can be appropriately determined in order to establish a satisfactorily balanced condition when the refrigerator is being driven. Further, the compressor chambers are located coaxially with respect to the displacer chambers. This type of known arrangement has been disadvantageous since the structures and arrangements are very complicated.

It is therefore an object of the present invention to provide a stirling cycle refrigerator of swash plate type which is simple in structure but can provide a smooth and efficient operation.

Another object of the present invention is to provide a well balanced stirling cycle refrigerator of two cylinder type.

According to the present invention, in order to accomplish the above and other object, there is provided a stirling cycle refrigerator which comprises a pair compression chambers provided at diametrically opposite positions, a pair of compressor pistons positioned respectively in said compression chambers for reciprocating movement therein, a pair of displacer chambers provided at diametrically opposite positions with each other, said displacer chambers being located along a diametrical line which makes an angle of 90° with respect to a diametrical line along which said compression chambers are located, a pair of displacer pistons positioned respectively in said displacer chambers for reciprocating movement therein, rotatable swash plate means associated with said compressing and displacer pistons for producing reciprocating movements of the pistons, one of said compressing chambers being connected with one of said displacer chambers, and the other compression chamber being connected with the other displacer chamber so that stirling cycles are effected when the swash plate means is rotated. The refrigerator may have heat exchanging means positioned between the pair of compressing chambers and between the pair of displacer chambers so that the gas from the compression chambers is passed in heat exchange relationship with a cooling medium so that an isothermal compression is performed.

Figure 1:
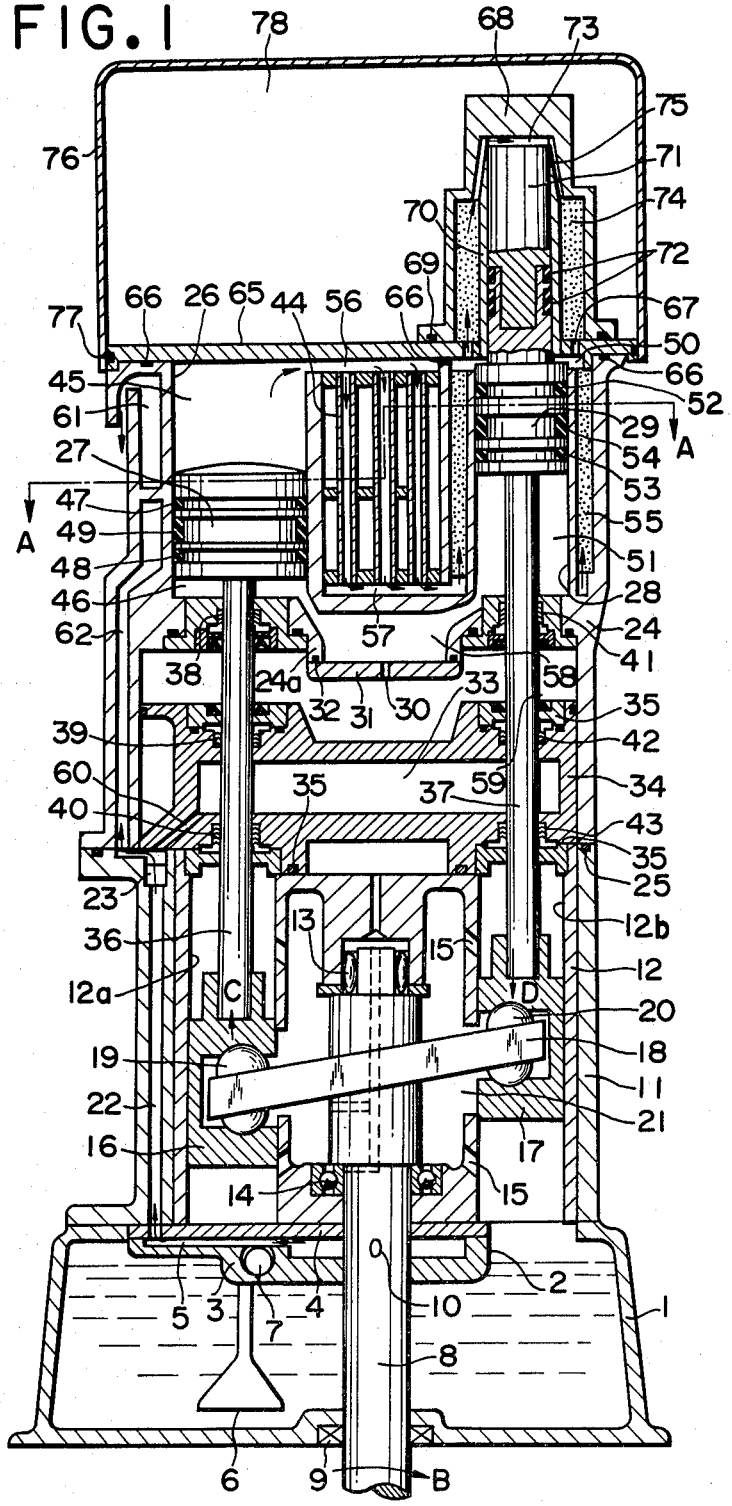
Figure 2:
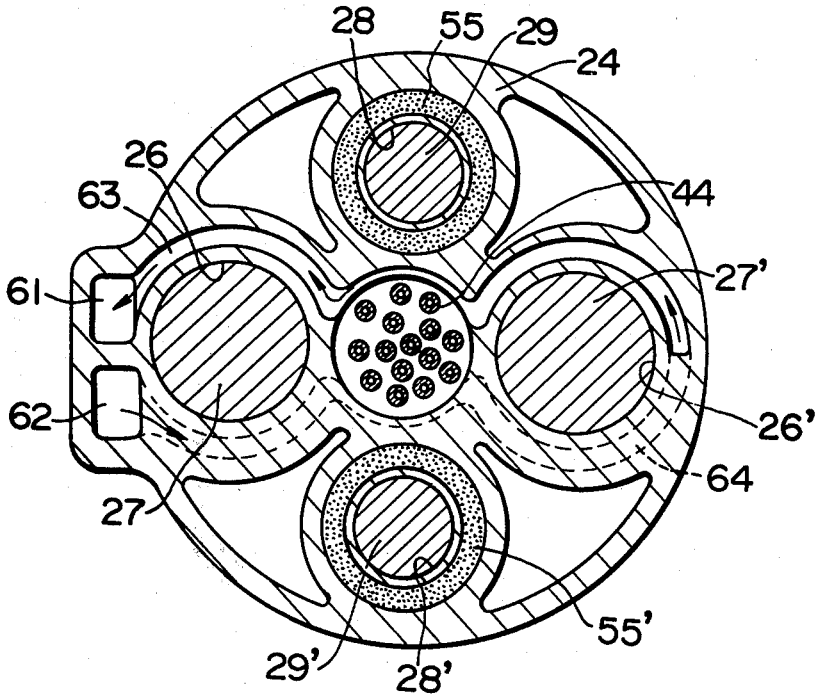

The above and other objects and features of the present invention will become apparent from the following descriptions of a preferred embodiment taking reference to the accompanying drawings, in which;

FIG. 1 is an axial sectional view of a stirling cycle refrigerator in accordance with one embodiment of the present invention; and, FIG 2 is a cross-sectional view of the stirling cycle refrigerator taken substantially along the line A—A in FIG. 1.

Referring now to the drawings, particularly to FIG. 1, there is shown a two cylinder stirling cycle refrigerator of a swash plate type which comprises an oil reservoir 1 for containing oil and an oil pump 2 provided in the oil tank 1. The oil pump is comprised of a pump body 3 and a pump base plate 4. The pump body 3 is formed with an outlet passage 5 and an inlet passage (not shown).

The oil in the oil reservoir 1 is taken into the pump body 3 through a strainer 6. A relief valve 7 is provided in the outlet passage 5 for limiting the pressure of oil in the outlet passage within a predetermined limit.

A power input shaft 8 extends through the oil reservoir 1 and has a lower end adapted to be connected with a primemover such as an internal combustion engine. An oil seal 9 may be provided about the input shaft 8. Although not shown in the drawings, the oil pump 2 has a rotatable member which is secured to the input shaft 8 by means of a key 10 so as to be driven by the shaft 8.

Above the oil reservoir 1, there is provided a lower casing 11 which is secured to the reservoir 1 and has a cylinder block 12 fitted inside the lower casing 11. The cylinder block carries a needle bearing 13 and a radial bearing 14 for rotatably supporting the input shaft 8. The cylinder block 12 is formed with four cylinder bores **12*a* and 12*b* which slidably receive compressor driving pistons 16 and the displacer driving pistons 17, respectively. The pistons 16 and 17 are connected respectively through joints 19 and 20 with a swash plate 18 which is secured to the input shaft 8. In order that the pistons 16 and 17 be freely movable, each of the cylinder bores 12 and 12*b* is formed with relief apertures 15 which connect the inside of the cylinder bore with a space provided in the cylinder block 12**.

The lower case 11 is formed with an oil passage 22 which is connected at one end with the pump outlet passage 5 and at the other end opened to the upper end of the lower casing 11. A check valve 23 is provided at the upper end of the passage 22 in the lower casing 11.

An upper casing 24 is secured to the upper end of the lower casing 11 with a sealing member 25 interposed therebetween. As shown in FIG. 2, the upper casing 24 is formed at diametrically opposite positions with a pair of cylinder bores 26 and 26' for receiving compressing pistons 27 and 27', respectively. The upper casing 24 is further formed with a pair of diametrically opposite cylinder bores 28 and 28' for receiving first displacer pistons 29 and 29'. As shown in FIG. 1, the upper casing 24 carries a capillary plate 31 which has a capillary aperture 30 and is secured to the upper casing 24 through a seal 32.

Beneath the capillary plate 31, there is disposed an intermediate plate 34 which is secured to the lower casing 11 with a seal 35 interposed therebetween. The intermediate plate 34 has an oil pressure chamber 33 formed therein. The pistons 16 and 27 are connected together by means of a piston rod 36 which passes through the intermediate plate 34 with seals 39 and 40 between the plate 34 and the piston rod 36. Similarly, the piston 27' is connected with a piston which is similar to the piston 16 by means of a piston rod (not shown).

The first displacer piston 29 is connected with the displacer driving piston 17 by means of a piston rod 37 which passes through the intermediate plate 34 with seals 42 and 43 between the plate 34 and the piston rod 37. Similarly, the piston 29' is connected with a piston which is similar to the piston 17. At the lower end portions of the cylinder bores 26, 26', 28 and 28', there are provided sealing members 38 and 41 which encircle the piston rods 36 and 37. At the upper end portion of the upper casing 24, there is provided a heat exchanger 44.

In the cylinder bore 26, there are defined a compressing chamber 45 and a lower chamber 46 above and below the piston 27. Similarly, a compressing chamber and a lower chamber are defined in the cylinder bore 26' by means of the piston 27'. In order to separate the compressing chamber from the lower chamber, each of the pistons 27 and 27' is provided with piston rings 47 and 48 and a rider ring 49 which is disposed between the piston rings 47 and 48.

In the cylinder bore 28, there are defined a first displacer chamber 50 and a lower chamber 51 above and below the first displacer piston 29. Similarly, the first displacer piston 29' defines in the cylinder bore 28' a first displacer chamber and a lower chamber. In order to separate the first displacer chamber from the lower chamber in the cylinder bore 28 or 28', each of the first displacer pistons 29 and 29' is provided with piston rings 52 and 53 and a rider ring 54 which is disposed between the piston rings 52 and 53.

Around the cylinder bores 28 and 28', there are provided first cryogenic accummulators 55 and 55', respectively. The accummulators 55 and 55' are connected with the compressing chambers 45 through a passage 56, the inside passages in heat exchanging pipes in the heat exchanger 44 and a pasaage 57. The lower chambers 46 in the compressing cylinder bores 26 and 26' are in communication with the lower chambers 51 in the displacer cylinder bores 28 and 28' through a buffer tank 58 which is defined above the capillary plate 31.

Between the capillary plate 31 and the intermediate plate 34, there is defined an intermediate chamber 59 which is in communication with the buffer tank 58 through the capillary aperture 30 in the plate 31. The oil passage 22 in the lower casing 11 is connected through the previously described check valve 23 and a passage 60 in the intermediate plate 34 with the oil pressure chamber 33. The upper casing 24 is formed with an upper passage 61 and a lower passage 62 which are connected together through passages 63 and 64 formed around the compressing cylinder bores 26 and 26' and the heat exchanger 44. The lower passage 62 is in communication with the oil passage 22 in the lower casing 11 through the check valve 23. The upper passage 61 is connected with the oil reservoir 1.

The upper end of the upper casing 24 is closed by a cover plate 65 which is secured thereto with an oil seal member 66 interposed therebetween. As shown in FIG. 1, the cover plate 65 carries a cold head 68 which is secured thereto with an intervention of a seal member 69 at a position coaxially with the cylinder bore 28. Although not shown in the drawings, another cold head which is similar to the head 68 is provided coaxially with the cylinder bore 28'. Since both of the cold heads are identical in construction, descriptions will be made only with respect to the cold head 68 which is shown in FIG. 1.

In the cold head 68, there is defined a cylinder 70 which slidably receives a second displacer piston 71. The piston 71 is threadably engaged with the first displacer piston 29 so that the pistons 29 and 71 are moved as a unit. The second displacer piston has piston rings 72 at a portion where the piston 72 is connected with the piston 29. The second displacer piston 71 defines a second displacer chamber 73 in the upper portion of the cylinder bore 70. A second cryogenic accummulator 74 is provided around the cylinder bore 70 and has a lower end connected through passages 67 with the first displacer chamber 50 and an upper end connected through passages 75 with a second displacer chamber 73. The cover plate 65 and the heads 68 are enclosed in a vacuum dome 76 which is secured to the cover plate 65 with a seal member 77 interposed therebetween. The cover plate 65 and the vacuum dome 76 define a vacuum chamber 78 in which the heads 68 are located.

In operation, the imput shaft 8 is rotated in the direction as shown by an arrow B in FIG. 1. The pump 2 is thus driven by the input shaft 8 so that the oil in the oil reservoir 1 pumped through the outlet passage 5, the passage 22 and the check valve 23 and then on one hand through the passage 60 to the oil pressure chamber 33 and on the other hand through the passages 62, 64, 63, and 61 to be returned to the oil reservoir 1.

As the input shaft 8 rotates, the swash plate 18 is also rotated so as to produce reciprocating movements of the piston rods 36 and 37.

When the piston rod 36 is moved upwards as shown by an arrow C in FIG. 1, the compressing piston 27 is also moved upwards to compress cooling gas such as helium, nitrogen or algon in the compressing chamber 45.

The compression takes place substantially under an isothermal condition.

The compressed gas is then introduced through the passage 56 into the heat exchanger 44 to be brought into a heat exchange relationship with the medium around the heat exchange tubes. The gas is then passed through the first cryogenic accummulator 55 to be cooled therein and thereafter into the first displacer chamber 50. The gas is further passed through the passages 67 into the second cryogenic accummulator to be further cooled and thereafter through the passage 75 into the second displacer chamber 73.

As the piston rod 37 is moved downwards in this instance as shown by an arrow D in FIG. 1, the gas introduced into the first and second displacer chambers 50 and 73 are expanded and the temprature of the gas is decreased. The decreased temperature of the gas is effectively utilized to cool down the first and second accummulators 55 and 74 and at the same time taken out through the cold head 68 as a refrigerating output. Since the chamber 78 is maintained under a vacuum, the cryogenic condition is maintained always constant. The compression and expansion in the chamber 45 take place under an isothermal condition due to the existence of the heat exchanger 44 which the compression and expansion in the chambers 50 and 73 take place under a adiabatic condition.

As shown in FIG. 2, the compressing pistons 27 and 27' are located at diametrically opposite positions and the displacer pistons 29 and 29' are also located at diametrically opposite positions. The pistons 29 and 29' are along a diametrical line which is perpendicular to a diametrical line along which the pistons 27 and 27' are located. The first cryogenic accummulators 55 and 55' are located around and coaxially with the first displacer pistons 29 and 29'. The heat exchanger 44 is at the center of the upper casing 24.

Thus, a smooth and efficient operation can be ensured with the two cylinder type construction.

The feature of the present invention is that the compressing chambers and the displacer chambers are not axially aligned but located along perpendicularly intersecting diametrical lines. Therefore, it is possible to provide a structurally simple, compact and less expensive arrangement.

The advantages of the present invention is more significant when the invention is applied to a refrigerator of a small size. In case of a four cylinder type refrigerator, the effective diameter of a displacer piston will be as small as 6.5 mm for 30 W (77° K.) refrigerating output and it is quite difficult to machine bores for such small dispaacer pistons. According to the present invention, the effective diameter of the displacer piston can be increased up to approximately 9 mm. Further, according to the present invention, it is possible to increase the ratio of output to input as compared with a conventional four cylinder type refrigerator.

The invention has thus been shown and described with reference to a specific embodiment, however, it should be noted that the invention is in no way limited to the details of the illustrated structures but changes and modifications may be made without departing from the scope of the appended claims.

We claim:

1. Stirling cycle refrigerator which comprises a pair of compression chambers provided at diametrically opposite positions, a pair of compressor pistons positioned respectively in said compression chambers for reciprocating movement therein, a pair of displacer chambers provided at diametrically opposite positions with each other, said displacer chambers being located along a diametrical line which makes an angle of 90° with respect to a diametrical line along which said compression chambers are located, a pair of displacer pistons positioned respectively in said displacer chambers for reciprocating movement therein, rotatable swash plate means associated with said compressing and displacer pistons for producing reciprocating movements of the pistons, one of said compressing chambers being connected with one of said displacer chambers, and the other compression chamber being connected with the other displacer chamber so that stirling cycles are effected when the swash plate means is effected.

2. Refrigerator in accordance with claim 1 which further comprises heat exchange means for cooling medium compressed in the compression chambers so that an isothermal compression is performed, said heat exchange means being positioned between the pair of compression chambers and between the pair of displacer chambers.

3. Refrigerator in accordance with claim 1 which further includes a cryogenic accummulator provided around and coaxially with each of the displacer chambers so that medium from the compression chambers is passed through the accummulators into the displacer chambers.

4. Refrigerator in accordance with claim 3 in which a second displacer chamber is provided coaxially with each of said first mentioned displacer chambers, a second cryogenic accummulator being provided around and coaxially with each of the second displacer chambers so that the medium from the first displacer chamber is passed through the second accummulator to the second displacer chamber.

5. Refrigerator in accordance with claim 4 in which the second displacer chamber is encircled by a cold head which is enclosed in a vacuum chamber.

* * * * *